US011638991B2

(12) United States Patent
Gowthorpe et al.

(10) Patent No.: US 11,638,991 B2
(45) Date of Patent: May 2, 2023

(54) TILTING ASSEMBLY TABLE

(71) Applicant: Honda Motor Co., Ltd., Tokyo (JP)

(72) Inventors: Matthew Gowthorpe, Burlington (CA); Benjamin B. MacArthur, Barrie (CA)

(73) Assignee: Honda Motor Co., Ltd., Tokyo (JP)

( * ) Notice: Subject to any disclaimer, the term of this patent is extended or adjusted under 35 U.S.C. 154(b) by 289 days.

(21) Appl. No.: 17/141,410

(22) Filed: Jan. 5, 2021

(65) Prior Publication Data

US 2022/0212336 A1 Jul. 7, 2022

(51) Int. Cl.
*B25H 1/18* (2006.01)
*B25H 1/02* (2006.01)

(52) U.S. Cl.
CPC ..... *B25H 1/18* (2013.01); *B25H 1/02* (2013.01)

(58) Field of Classification Search
CPC ..... A47B 13/081; A47B 2009/003; A47B 2200/0036; A47B 2200/0043; A47B 2200/0046; B23Q 1/525; B25H 1/02; B25H 1/04; B25H 1/18; B62B 3/08
See application file for complete search history.

(56) References Cited

U.S. PATENT DOCUMENTS

| | | | | |
|---|---|---|---|---|
| 4,880,194 | A * | 11/1989 | Geise | B05B 13/0285 248/176.1 |
| 7,753,629 | B1 | 7/2010 | McCulloch | |
| 9,415,317 | B2 | 8/2016 | Hatfield | |
| 10,654,505 | B1 * | 5/2020 | Brooks | B62B 3/001 |
| 2019/0168375 | A1 * | 6/2019 | Castro | A47B 85/06 |

FOREIGN PATENT DOCUMENTS

| | | | |
|---|---|---|---|
| CN | DN201913633 | U | 8/2011 |
| CN | DN106695706 | B | 10/2018 |
| CN | 106584377 | B | 1/2019 |
| CN | 209665320 | U | 11/2019 |
| CN | 210389134 | U | 4/2020 |

* cited by examiner

*Primary Examiner* — Tyrone V Hall, Jr.
(74) *Attorney, Agent, or Firm* — Mark Duell; American Honda Motor Co., Inc.

(57) ABSTRACT

A tilting assembly table located on a surface includes a frame having first, second, and third horizontal members parallel to each other. The assembly table further includes a base plate rotatably mounted to the first horizontal member, the base plate having a first end and a second end and being rotatable from a first position wherein the first end of the base plate contacts the second horizontal member to a second position wherein the second end of the base plate contacts the third horizontal member. The base plate further includes, at least one channel mounted to a bottom side of the base plate, and at least one ball bearing movable between a first end of the channel when the base plate is in the first position and a second end of the channel when the base plate is in the second position.

20 Claims, 4 Drawing Sheets

TILTING ASSEMBLY TABLE

TECHNICAL FIELD

The embodiments disclosed herein relate to an ergonomic assembly table in a manufacturing environment

BACKGROUND

There is an identified need for a tilting table that puts a work component into the correct position for a manufacturing associate to assemble or repair without any need for part manipulation with a goal to improve efficiency and ergonomics in the process.

APPLICATION SUMMARY

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

According to one aspect, an assembly table located on a surface includes a frame, the frame having a first horizontal member located at a first elevation above the surface, a second horizontal member parallel to the first horizontal member and located at a second elevation above the surface, the second elevation being less than the first elevation, and a third horizontal member parallel to the first and second horizontal members and located at a third elevation above the surface, the third elevation being less than the first elevation. The assembly further includes a base plate rotatably mounted to the first horizontal member, the base plate having a first end and a second end, the base plate being rotatable from a first position wherein the first end of the base plate contacts the second horizontal member to a second position wherein the second end of the base plate contacts the third horizontal member, a first channel mounted to a bottom side of the base plate, and a first ball bearing movable between a first end of the first channel when the base plate is in the first position and a second end of the first channel when the base plate is in the second position.

According to another aspect, an assembly table located on a surface includes a frame having a first horizontal member located at a first elevation above the surface, a second horizontal member parallel to the first horizontal member and located at a second elevation above the surface, the second elevation being less than the first elevation, and a third horizontal member parallel to the first and second horizontal members and located at a third elevation above the surface, the third elevation being less than the first elevation. The assembly table further includes a base plate rotatably mounted to the first horizontal member, the base plate having a first end and a second end, the base plate being rotatable from a first position wherein the first end of the base plate contacts the second horizontal member to a second position wherein the second end of the base plate contacts the third horizontal member, a channel mounted to a bottom side of the base plate, a ball bearing movable between a first end of the channel when the base plate is in the first position and a second end of the channel when the base plate is in the second position, a first damper at a first end of each of the channel, the first damper damping the ball bearing when the base plate moves to the first position, and a second damper at a second end of the channel, the second damper damping the ball bearing when the base plate moves to the second position.

According to yet another aspect, a method of assembling a component on an assembly table, wherein the assembly table includes a frame, and base plate rotatable between a first position and as second position mounted to the frame, and a channel mounted to the base plate having a ball bearing that is movable between a first end of the channel when the base plate is in the first position and a second end of the channel when the base plate is in the second position, includes the steps of moving the component to the assembly table when the base plate is in the first position, rotating the base plate to the second position to complete assembly of the component, rotating the base plate to the first position when assembly of the component is completed, and removing the component from the assembly table.

The figures depict various embodiments for purposes of illustration only. One skilled in the art will readily recognize from the following discussion that alternative embodiments of the structures and methods illustrated herein may be employed without departing from the principles of the embodiments described herein.

DETAILED DESCRIPTION

Figure 1:
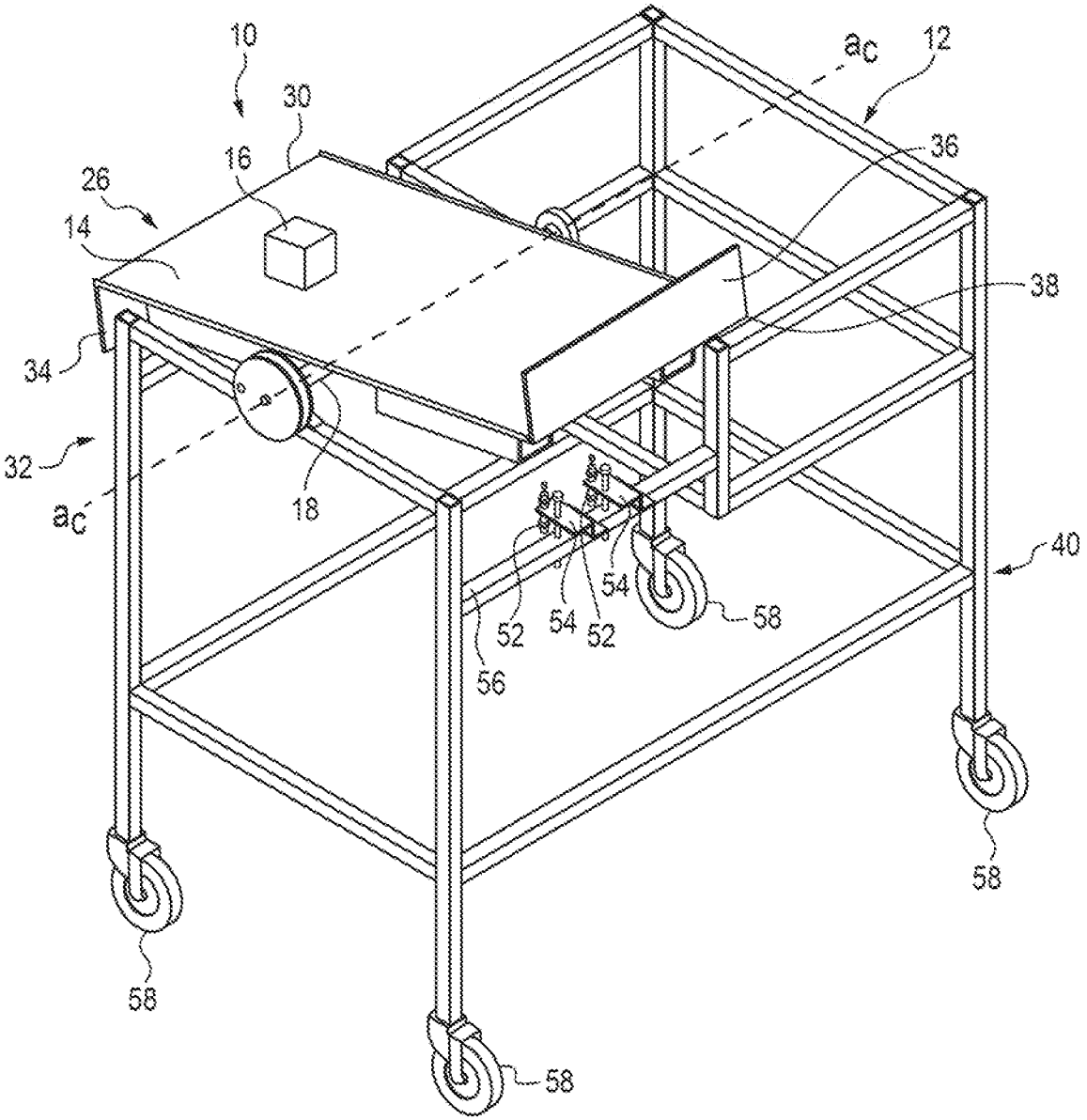
FIG. 1 is a perspective view of a tilting assembly table.

FIG. 1 illustrates an embodiment of an assembly table 10 that uses the concept of shifting balance and weight to create a more efficient and ergonomic assembly table 10 in a manufacturing environment. The assembly table 10 includes a frame 12 and a base plate 14, which holds a component 16 to be assembled, such as, but not limited to, an HVAC unit or any other vehicle component. The base plate 14 may be mounted to the frame on a center first horizontal member 18 that acts as center axis ac about which the base plate 14 may rotate or pivot.

Figure 2:
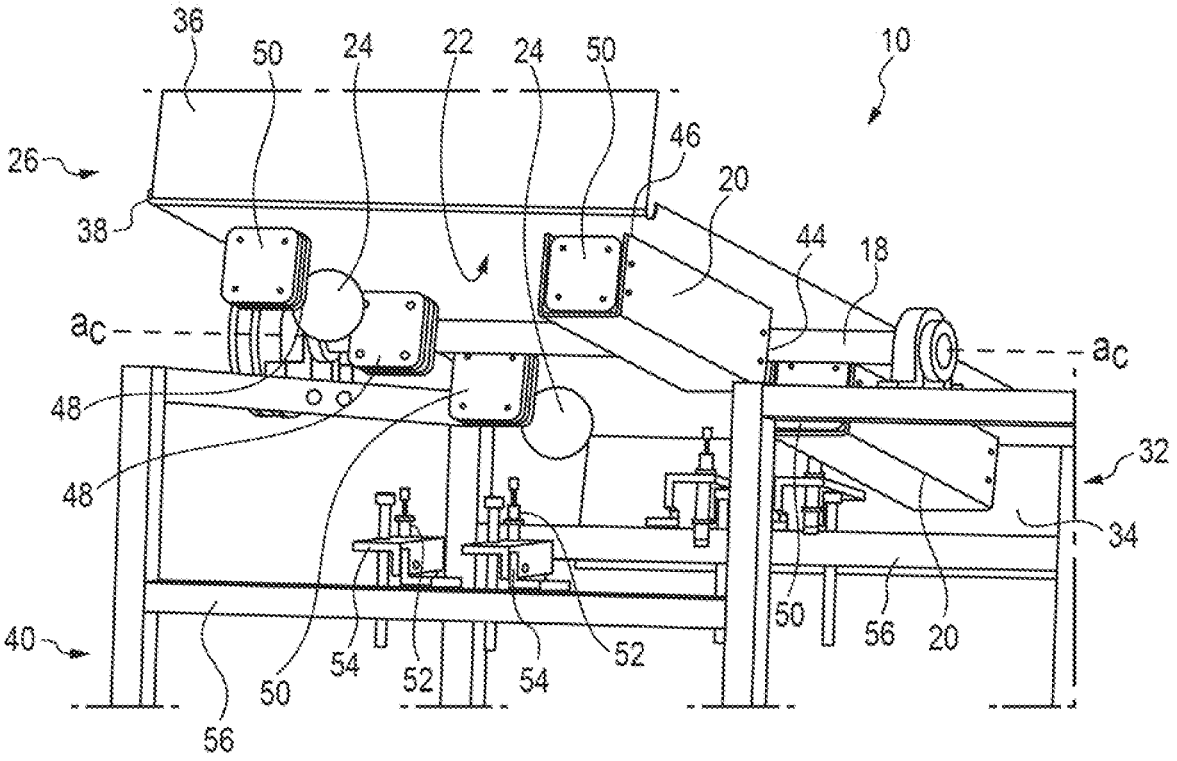
FIG. 2 is a bottom perspective view of the bottom side of a base plate of the assembly table of FIG. 1 with channels removed to reveal the inside of the channels.
Figure 3:
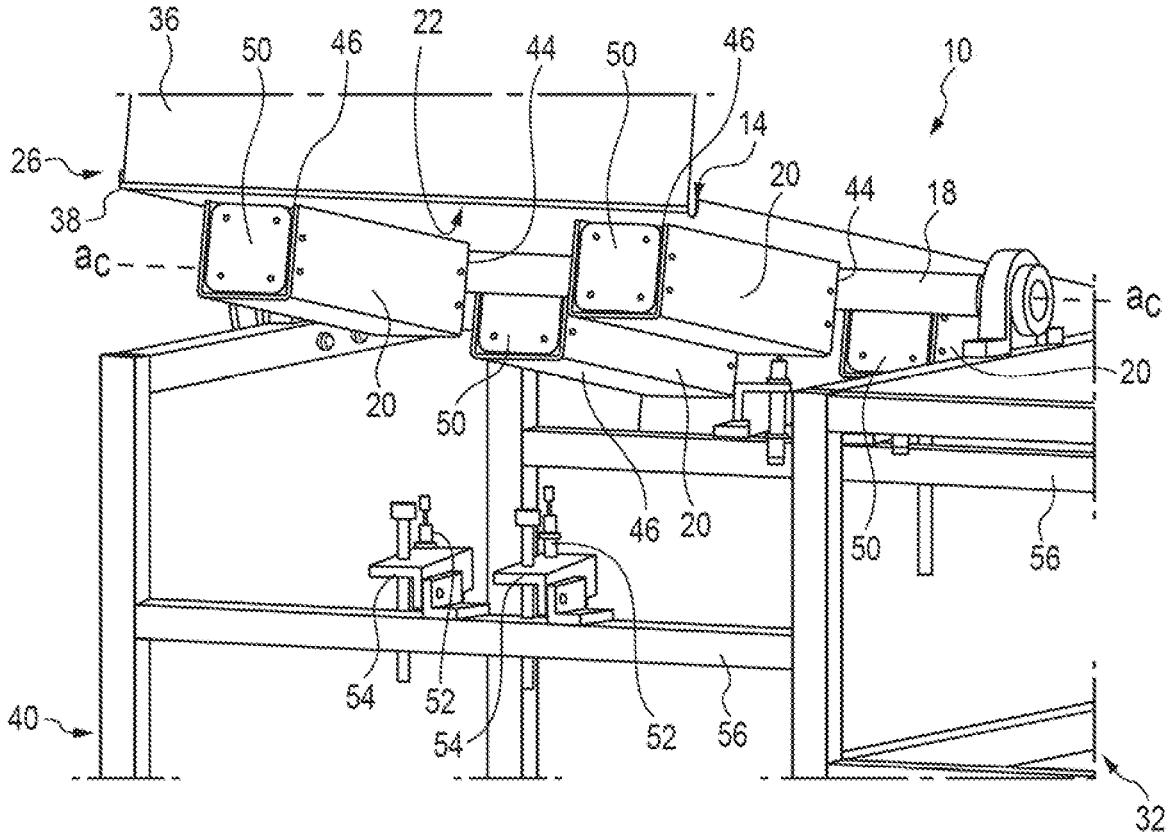
FIG. 3 is a bottom perspective view of the bottom side of the base plate of the assembly of FIG. 1.
Figure 4:
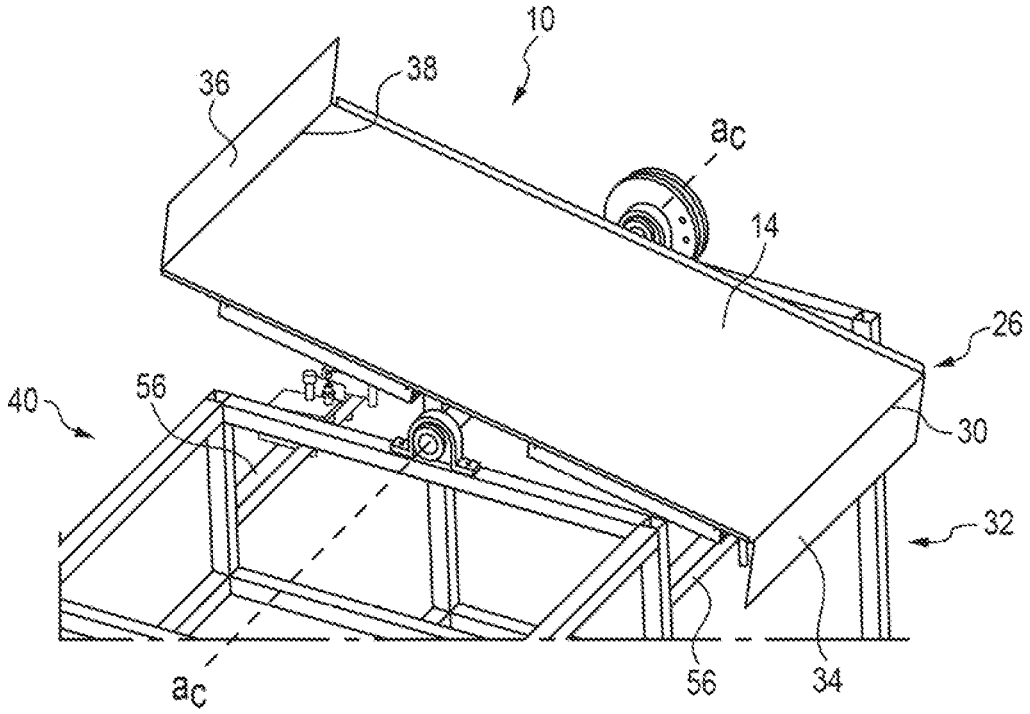
FIG. 4 is a top perspective view of the tilting assembly table of FIG. 1 in a first position.

In the embodiment illustrated in FIGS. 2-3, four (4) channels 20 are mounted, such as by welding, fasteners, adhesives, or any other method, to the bottom side 22 of the base plate 14. Each of these channels 20 may house one (1) of four (4) ball bearings 24, illustrated in FIG. 2 where two of the channels 20 are removed, each of which are capable of rolling back and forth and shifting the balance of the base plate 14 to either a first position 26, illustrated in FIGS. 1-4 or a second position 28, illustrated in FIG. 5.

Each of the four (4) channels 20 and base plate 14 are built so that the weight is balanced perfectly along the center axis ac unless disrupted by an external force. In a first position 26, as illustrated in FIGS. 1-4, the assembly table 10 lies in a down position at the first end 30 of the base plate 14 with each of the four (4) ball bearings 24 shifted to a first side 32 the assembly table 14. This first position 26 is where a work piece 16 would be placed onto the assembly table 10

As illustrated in FIGS. 1-5, and a first extension 34 may extend generally perpendicular and downward from the first end 30 of the base plate 14. As further illustrated, a second extension 36 may extend generally perpendicular and upward from a second end 38 of the base plate 14 on the second side 40 of the assembly table 10. The second extension 36 prevents the component 16 from sliding off the base plate 14 while in the second position 28. The first and second extensions 34, 36 further ensure that the first and second ends 30, 38 of the base plate 14 do not contain sharp or pointed edged surfaces.

Figure 5:
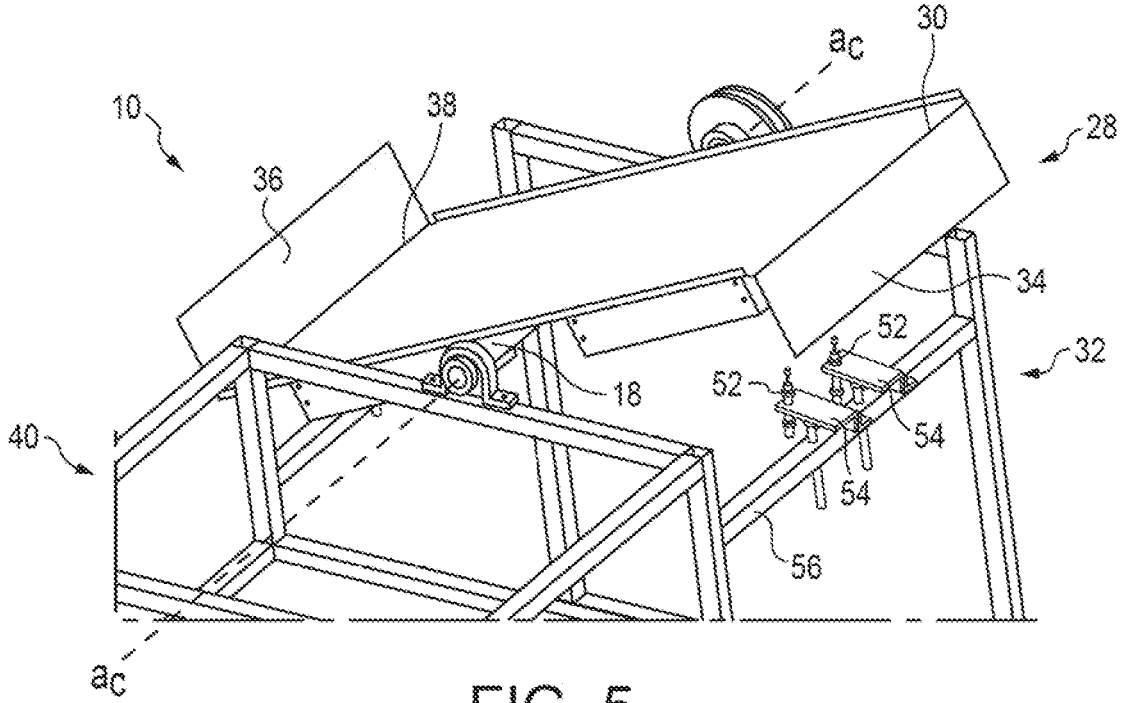
FIG. 5 is a top perspective view of the tilting assembly table of FIG. 1 in a second position.

Once the component 16 is placed on the assembly table 14 and pushed towards a second side 40 of the assembly table 10, the base plate 14 shifts into a second position 28 as illustrated in FIG. 5.

This second position 28 may be placed at an ergonomic height for the user to complete the assembly, repairs, or other work on the component 16. To remove the component 16 towards the first side 32 of the assembly table 10. This action will again shift the weight towards the first side 32, putting the assembly table 10 back into the first position 26 and ready for the next component 16 to be assembled, completed, or on which work is to be done.

FIGS. 2-3 illustrate the weight mechanism underneath the base plate 14. FIG. 2 in particular illustrates the weight mechanism with two of the channels 20 not shown to further illustrate what is located inside of the channels 20. One (1) ball bearing 24, made of steel or any other suitably weighty material, is housed within each of the four (4) channels 20. Both the first end 44 and second end 46 of each the four (4) channels 20 includes a damper 48. The damper 48 may be made of a 75 durometer soft urethane or any other suitable material to dampen and absorb the energy of the ball bearing 24 when the mass is shifted between the first and second sides 32, 40 of the channels 20 and assembly table 10. Each of the dampers 48 is mounted to an end cap 50 for the channels 20 made of aluminum 6061 or any other suitable material, which prevents each of the ball bearings 24 from escaping the respective channel 20.

FIG. 1-5 illustrate shock absorbers 52 that may be installed directly to the frame 12 on either side 32, 40 of the assembly table 10 using brackets 54. The shock absorbers 52 are used to absorb the kinetic energy when the base plate 14 is shifting its weight between the first and second positions 26, 28. The shock absorbers 52 are mounted to the brackets 54 that allow the user to adjust the height and angle at which the base plate 14 is stopped at in each of the first and second positions 26, 28. This feature allows the angle of the assembly table 10 and position to be customizable to best fit the height of the user. In the illustrated embodiment, two (2) brackets 54 and two (2) shock absorbers 52 are mounted to each of two (2) horizontal members 56, for a total of four (4) brackets 54 and four (4) shock absorbers 52 to be applied, that are parallel to the center horizontal member 18, but lower in height from the floor in comparison to the center horizontal member 18, which allows the base plate 14 to rotate between the first and second positions 26, 28.

The assembly table 10 may be fixed to a surface, such as the floor of a manufacturing facility. Alternatively, the assembly table 10 may additionally include four locking caster wheels 58 that allow the assembly table 10 to be move and to position the assembly table as desired on the surface, as illustrated in FIG. 1.

Additionally, each of the ball bearings 24 may be wrapped in a thin layer of rubber and epoxied. This allow the ball bearings to activate, but reduces the sound of the ball bearings 24 travelling within the respective channels 20.

Reference in the specification to "one embodiment" or to "an embodiment" means that a particular feature, structure, or characteristic described in connection with the embodiments is included in at least one embodiment. The appearances of the phrase "in one embodiment" or "an embodiment" in various places in the specification are not necessarily all referring to the same embodiment.

In addition, the language used in the specification has been principally selected for readability and instructional purposes, and may not have been selected to delineate or circumscribe the inventive subject matter. Accordingly, the disclosure of the embodiments is intended to be illustrative, but not limiting, of the scope of the embodiments, which is set forth in the claims.

While particular embodiments and applications have been illustrated and described herein, it is to be understood that the embodiments are not limited to the precise construction and components disclosed herein and that various modifications, changes, and variations may be made in the arrangement, operation, and details of the methods and apparatuses of the embodiments without departing from the spirit and scope of the embodiments as defined in the appended claims.

What is claimed is:

1. An assembly table located on a surface, comprising:

a frame, the frame comprising:

a first horizontal member located at a first elevation above the surface;

a second horizontal member parallel to the first horizontal member and located at a second elevation above the surface, the second elevation being less than the first elevation; and a third horizontal member parallel to the first and second horizontal members and located at a third elevation above the surface, the third elevation being less than the first elevation;

a base plate rotatably mounted to the first horizontal member, the base plate having a first end and a second end, the base plate being rotatable from a first position wherein the first end of the base plate contacts the second horizontal member to a second position wherein the second end of the base plate contacts the third horizontal member;

a first channel mounted to a bottom side of the base plate; and a first ball bearing movable between a first end of the first channel when the base plate is in the first position and a second end of the first channel when the base plate is in the second position.

2. The assembly table of claim 1 wherein the second horizontal member further comprises:

a first shock absorber mounted on a top portion of the second horizontal member for contacting the base plate when the base plate is in the first position.

3. The assembly table of claim 2 wherein the third horizontal member further comprises:

a second shock absorber mounted on a top portion of the third horizontal member for contacting the base plate when the base plate is in the second position.

4. The assembly table of claim 2 wherein the second and third horizontal members further comprise:

a third shock absorber mounted on the top portion of the second horizontal member for contacting the base plate when the base plate is in the first position; and a fourth shock absorber mounted on the top portion of the third horizontal member for contacting the base plate when the base plate is in the second position.

5. The assembly table of claim 1 wherein the first channel mounted to the bottom side of the base plate further comprises:

a first damper at a first end of the first channel, the first damper damping the first ball bearing when the base plate moves to the first position; and a second damper at a second end of the first channel, the second damping the first ball bearing when the base plate moves to the second position.

6. The assembly table of claim 1 further comprising:

a second channel mounted to the bottom side of the base plate; and a second ball bearing movable between a first end of the second channel when the base plate is in the first position and a second end of the second channel when the base plate is in the second position.

7. The assembly table of claim 6 further comprising:

a third channel mounted to the bottom side of the base plate;

a fourth channel mounted to the bottom side of the base plate;

a third ball bearing movable between a first end of the third channel when the base plate is in the first position and a second end of the third channel when the base plate is in the second position; and a fourth ball bearing movable between a first end of the fourth channel when the base plate is in the first position and a second end of the fourth channel when the base plate is in the second position.

8. The assembly table of claim 7 wherein the first, second, third, and fourth channels mounted to the bottom side of the base plate further comprise:

a first damper at a first end of each of the first, second, third, and fourth channels, the first damper damping each of the first, second, third, and fourth ball bearings when the base plate moves to the first position; and a second damper at a second end of each of the first, second, third, and fourth channels, the first damper damping each of the first, second, third, and fourth ball bearings when the base plate moves to the second position.

9. The assembly table of claim 8 wherein the second horizontal member further comprises:

a first shock absorber mounted on a top portion of the second horizontal member for contacting the base plate when the base plate is in the first position.

10. The assembly table of claim 9 wherein the third horizontal member further comprises:

a second shock absorber mounted on a top portion of the third horizontal member for contacting the base plate when the base plate is in the second position.

11. The assembly table of claim 10 wherein the second and third horizontal members further comprise:

a third shock absorber mounted on the top portion of the second horizontal member for contacting the base plate when the base plate is in the first position; and a fourth shock absorber mounted on the top portion of the third horizontal member for contacting the base plate when the base plate is in the second position.

12. The assembly table of claim 11 wherein each of the first, second, third, and fourth ball bearings is coated so as to limit a sound of the first, second, third, and fourth ball bearings moving between the first and second positions of the first, second, third, and fourth channels.

13. The assembly table of claim 1 wherein the base plate further comprises:

a first extension extending generally downward and perpendicular from the first end of the base plate.

14. The assembly table of claim 13 wherein the base plate further comprises:

a second extension extending generally upward and perpendicular from the second end of the base plate.

15. An assembly table located on a surface, comprising:

a frame, the frame comprising:

a first horizontal member located at a first elevation above the surface;

a second horizontal member parallel to the first horizontal member and located at a second elevation above the surface, the second elevation being less than the first elevation; and a third horizontal member parallel to the first and second horizontal members and located at a third elevation above the surface, the third elevation being less than the first elevation;

a base plate rotatably mounted to the first horizontal member, the base plate having a first end and a second end, the base plate being rotatable from a first position wherein the first end of the base plate contacts the second horizontal member to a second position wherein the second end of the base plate contacts the third horizontal member;

a channel mounted to a bottom side of the base plate;

a ball bearing movable between a first end of the channel when the base plate is in the first position and a second end of the channel when the base plate is in the second position;

a first damper at a first end of each of the channel, the first damper damping the ball bearing when the base plate moves to the first position; and a second damper at a second end of the channel, the second damper damping the ball bearing when the base plate moves to the second position.

16. The assembly table of claim 15 further comprising:

a first shock absorber mounted on a top portion of the second horizontal member for contacting the base plate when the base plate is in the first position; and a second shock absorber mounted on a top portion of the third horizontal member for contacting the base plate when the base plate is in the second position.

17. The assembly table of claim 16 further comprising:

a first extension extending generally downward and perpendicular from the first end of the base plate; and a second extension extending generally upward and perpendicular from the second end of the base plate.

18. A method of assembling a component on an assembly table, the assembly table comprising a frame, and base plate rotatable between a first position and as second position mounted to the frame, and a channel mounted to the base plate having a ball bearing that is movable between a first end of the channel when the base plate is in the first position and a second end of the channel when the base plate is in the second position, the method comprising the steps of:

moving the component to the assembly table when the base plate is in the first position;

rotating the base plate to the second position to complete assembly of the component;

rotating the base plate to the first position when assembly of the component is completed;

removing the component from the assembly table.

19. The method of claim 18 wherein the ball bearing moves from the first end of the channel to the second end of the channel when the base plate is moved from the first position to the second position.

20. The method of claim 19 wherein the ball bearing moves from the second end of the channel to the first end of the channel when the base plate is moved from the second position to the first position.

* * * * *